United States Patent [19]

Gantke

[11] Patent Number: 4,881,851

[45] Date of Patent: Nov. 21, 1989

[54] CONNECTING ELEMENT FOR OFFSHORE DRILLING RIG

[75] Inventor: Franz Gantke, Dortmund, Fed. Rep. of Germany

[73] Assignee: Georg Fischer AG, Schaffhausen, Switzerland

[21] Appl. No.: 229,017

[22] Filed: Aug. 5, 1988

[30] Foreign Application Priority Data

Aug. 7, 1987 [DE] Fed. Rep. of Germany ..... 3726247

[51] Int. Cl.[4] ..... E02B 17/08

[52] U.S. Cl. ..... 405/204; 405/203; 405/195

[58] Field of Search ..... 405/204, 195, 203; 403/271, 272; 52/301; 182/178

[56] References Cited

U.S. PATENT DOCUMENTS

| | | | |
|---|---|---|---|
| 3,150,748 | 9/1964 | Liskey, Jr. | 52/301 |
| 4,329,088 | 5/1982 | Lucas | 405/203 X |
| 4,607,982 | 8/1986 | Brasted et al. | 405/204 |
| 4,629,365 | 12/1986 | Kuriiwa | 405/204 |
| 4,655,641 | 4/1987 | Weyler | 405/204 |
| 4,662,788 | 5/1987 | Kypke et al. | 405/204 |
| 4,723,875 | 2/1988 | Sutton | 405/204 |
| 4,761,097 | 8/1988 | Turner | 405/204 |

FOREIGN PATENT DOCUMENTS

| | | | |
|---|---|---|---|
| 2416306 | 10/1979 | France | 405/204 |
| 21614 | 2/1982 | Japan | 405/204 |

*Primary Examiner*—Dennis L. Taylor
*Assistant Examiner*—J. Russell McBee
*Attorney, Agent, or Firm*—Marmorek, Guttman & Rubenstein

[57] ABSTRACT

For rapid assembly of the deck of a drilling platform on a pipe scaffold, a connecting element made of two interlocking parts is described. The first part is in the form of a closing head integrated by casting into the end of a vertically standing pipe of the pipe scaffold, a ring-shaped horizontal support surface and a lifting bitt extending upward. The second part is in the form of a bell-shaped cover which envelops the lifting bitt. The cover on its upper surface is welded to the drilling platform, and at its underside includes a supporting surface which bears upon the supporting surface of the first part.

13 Claims, 3 Drawing Sheets

CONNECTING ELEMENT FOR OFFSHORE DRILLING RIG

BACKGROUND OF THE INVENTION

The instant invention relates to a connecting element for an offshore drilling rig. More particularly, the instant invention relates to a connecting element disposed between a vertically standing pipe of the pipe scaffold erected in water and a drilling platform of an offshore drilling rig.

A connecting element of this kind is described in French patent application 2,416,306 which has been published for public inspection.

When an offshore platform is being erected, it is customary to first tow the extremely heavy pipe scaffold which was preassembled on land in a horizontal, floating position to the site of its installation. It is there turned into vertical position by means of ballast and is connected to the foundation which has been prepared on the bottom of the sea.

As the pipe scaffold is rotated from its horizontal into its vertical position, the head of the pipe scaffold is held in a stable position by traction cables from a floating crane connected to lifting bitts which are attached on each pipe leg.

Normally the lifting bitts are removed after the pipe scaffold is deposited in place and the pipe heads of the scaffold are straightened and prepared for the installation of the deck. Much time is spent in these operations. High costs and certain weather risks are also incurred in these operations.

The instant invention has therefore as its object to provide a connecting element which has a lifting bitt on each pipe leg of a pipe scaffold so that a drilling platform can be attached to the pipe scaffold in a short period of time and without prior removal of the lifting bitt.

SUMMARY OF THE INVENTION

This object is achieved by the connecting element of the present invention which comprises first and second interconnected parts disposed between the pipe scaffolding and the drilling platform. The first part of the connecting element comprises a closing head connected to a vertical standing pipe of the pipe scaffolding, a ring-shaped horizontal supporting surface, and a lifting bitt extending upwardly from the closing head. The second part of the connecting element comprises a bell-shaped cover which attaches to the underside of the deck of the drilling platform and to the ring-shaped horizontal supporting surface. The cover is hollow and fits over the lifting bitt to envelop it.

Thanks to the present invention, the lifting bitts no longer hinder the positioning of the platform on the pipe scaffold.

BRIEF DESCRIPTION OF THE DRAWINGS

The invention is described in greater detail with reference to the embodiments shown in FIGS. 1–3, wherein.

DETAILED DESCRIPTION

Figure 1:
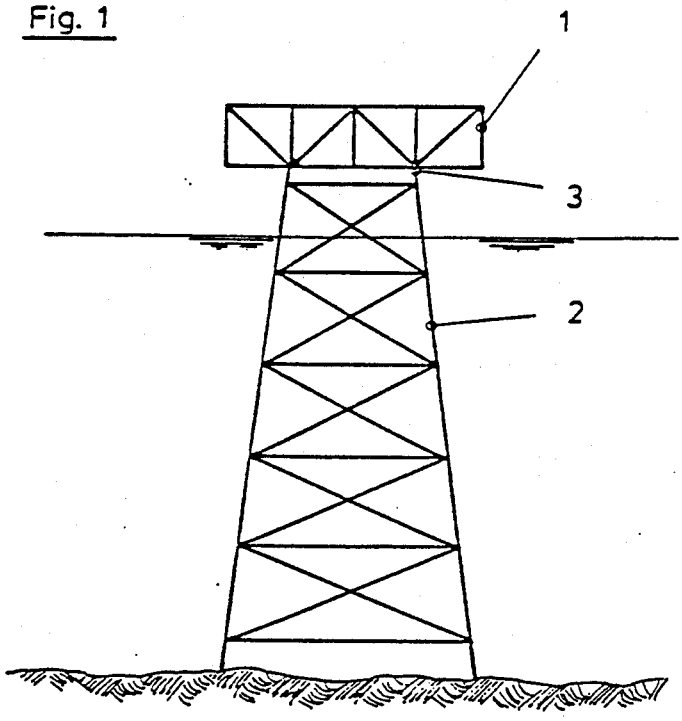
FIG. 1 shows an off-shore structure.

Referring to FIG. 1, an offshore drilling rig is shown which comprises drilling platform 1 and pipe scaffolding 2. The drilling rig is shown as it is installed in the water on the ocean floor.

Figure 2:
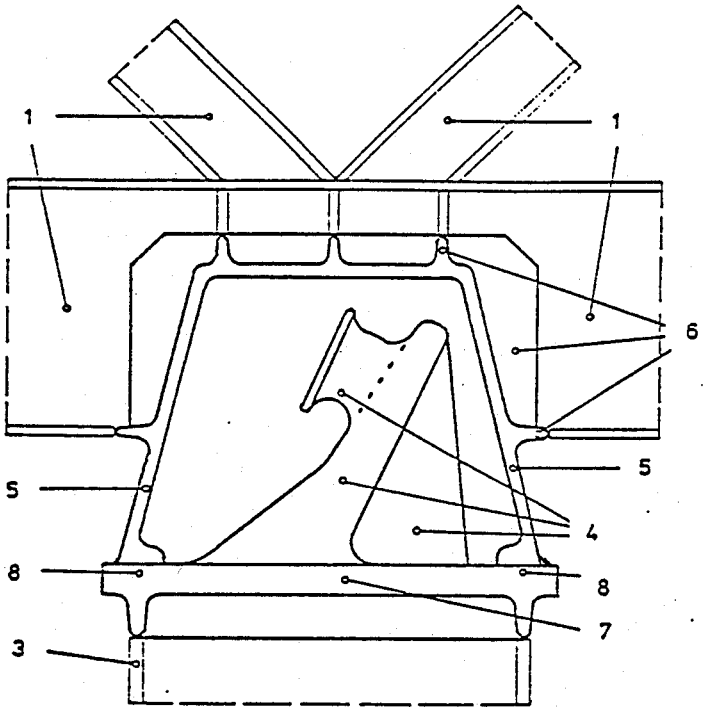
FIG. 2 shows a view of the connecting element of the present invention disposed between the pipe scaffolding and the drilling platform.

According to FIG. 2, the drilling platform 1 is supported by connecting elements on pipe scaffolding 2. Each connecting element comprises a bell 5 which fits over a lifting bitt 4 located on the upper end 3 of a pipe of the pipe scaffolding. The lifting bitt 4 is preferably made of cast steel and is integral with a closing head 7 which includes a supporting surface 8 around the lifting bitt 4. Supporting surface 8 provides a resting surface for the bell 5.

It is obvious that the lifting bitt 4 must be sufficiently small to fit within the bell 5, so that the bitt 4 need not be removed. Bitt 4 must furthermore be immune to local shocks during the positioning process. Both of these conditions make it desirable for the lifting bitt 4 to be made of cast steel and integral with closing head 7.

The bell 5 serves as a cap for the upper end 3 of the pipes of the pipe scaffolding 2, and further serves as a support for platform 1. Bell 5 thereby transmits the high bearing forces of the deck structure via support surface 8 of the closing head 7 in very straight lines into the walls of the upper end 3 of each pipe. This considerably reduces the dead weight of the steel structure.

The bell 5 is preferably provided on its outer surface with integrated ribs 6 having welding bevels for welding of the surrounding deck structure. The form of the bell 5 is particularly well suited for distributing these ribs about the bells and for transmitting stress forces into the surrounding deck structure. It is advantageous to make the bell 5 from cast steel because it is exposed to unavoidable impacts in its lower regions during installation.

Instead of the bell-shaped configuration, the cover for lifting bitt 4 can have any other internally hollow form. It can also be constructed in the form of a rectangular box with connections for double-T bearers. It is advantageous for the transmission of the forces resulting from the weight of the platform 1 for the cover to be in the form of a hemisphere, for example.

To make it possible to place the bell 5 safely over the lifting bitt 4 during the unavoidable oscillations caused by the movement of the sea, it is possible to form cable guiding elements which extend obliquely relative to the supporting surface in the nature of the ribs against the lifting bitt. These ribs can also be attached within the bell or on the outside surface of the bell.

Figure 3:
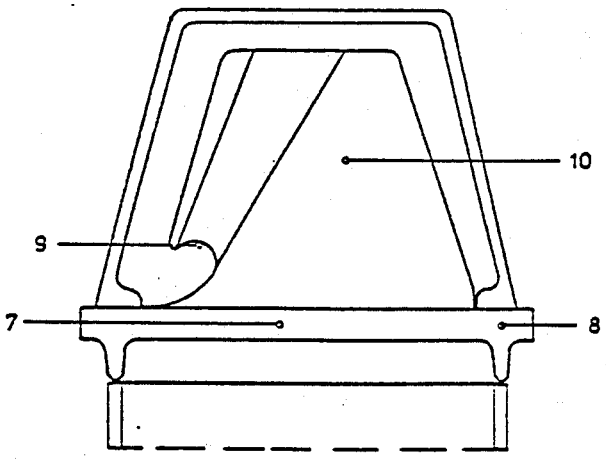
FIG. 3 shows a second embodiment of a lifting bitt of the present invention.

To be able to absorb even heavy impacts, it is advantageous for the lifting bitt itself to be of such configuration that its outer surfaces serve as guiding elements. Such a lifting bitt in the form of a truncated cone 10 is shown in FIG. 3. In this embodiment, the cable is guided in groove 9. The lower outer diameter of the lifting bitt shown in FIG. 3 is substantially equal to the lower inner diameter of the bell.

Figure 4:
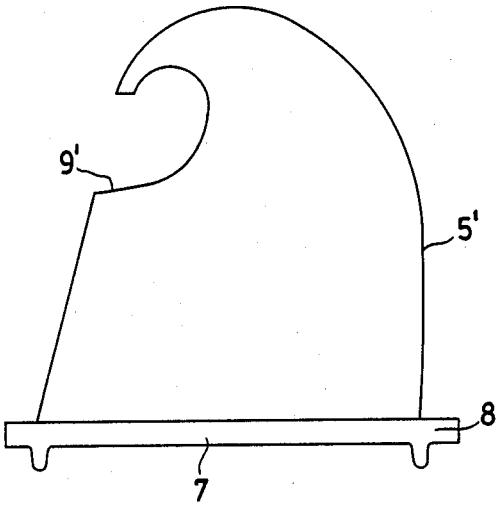
FIG. 4 shows a second embodiment of the bell that covers the lifting bitt of the present invention.

FIG. 4 shows a bell 5′ that is hemispherically shaped. Bell 5′ includes cable guiding groove 9′ on its outer surface.

While the invention has been described by reference to specific embodiments, this was for purposes of illustration only and should not be construed to limit the spirit or scope of the invention.

I claim:

1. A connecting element disposed between a pipe scaffolding and a drilling platform of an offshore drilling rig, comprising first and second interconnected parts, said first part comprising a closing head for attachment to an upper portion of said pipe scaffolding, said closing head having a supporting surface, and lifting bitt extending upwardly from said closing head, said second part comprising a hollow cover for attachment to a lower portion of said drilling platform, said cover including a hollow chamber for enveloping said lifting bitt, said cover being supported by said supporting surface and being interconnected to said closing head.

2. The connecting element of claim 1 wherein said cover is interconnected to said supporting surface.

3. The connecting element of claim 2 wherein said lifting bitt includes a base, and said supporting surface is ring-shaped and surrounds said base of said lifting bitt.

4. The connecting element of claim 1 wherein said cover is bell-shaped.

5. The connecting element of claim 1 wherein said cover is hemispherically-shaped.

6. The connecting element of claim 1 wherein said cover is cylindrically-shaped.

7. The connecting element of claim 1 wherein said cover includes connecting means for attachment to said drilling platform.

8. The connecting element of claim 7 wherein said connecting means comprises ribs on an outside surface of said cover.

9. The connecting element of claim 8 wherein said cover is made from cast steel, said ribs being integrally cast with said cover.

10. The connecting element of claim 1 wherein said lifting bitt and said closing head are made integrally from cast steel.

11. The connecting element of claim 1 further comprising cable guiding elements.

12. The connecting element of claim 11 wherein said cable guiding elements extend obliquely upwardly relative to said supporting surface.

13. The connecting element of claim 1 wherein said lifting bitt is in the form of a truncated cone, a lower outer diameter of said lifting bitt being substantially equal to a lower inside diameter of said cover.

* * * * *